US005819976A

United States Patent [19]

Boehm et al.

[11] Patent Number: 5,819,976

[45] Date of Patent: Oct. 13, 1998

[54] CLOSURE HAVING SELF-VENTING, SEALED PROMOTION COMPARTMENT

[75] Inventors: Ted W. Boehm; David L. Cerny, both of Crawfordsville; Wendell D. Willingham, Zionsville; Daniel J. Denman, Crawfordsville; Sheldon L. Wilde, Indianapolis; Stephen W. McBride, Brownsburg; Hugh C. Urmston, Carmel, all of Ind.; Ralph H. Whitney, Venice, Fla.; David E. Babcock, Lafayette, Ind.; Joseph M. Ladina, Marietta, Ga.

[73] Assignee: Alcoa Closure Systems International, Crawfordsville, Ind.

[21] Appl. No.: 746,710

[22] Filed: Nov. 15, 1996

[51] Int. Cl.[6] ..... B65D 1/10

[52] U.S. Cl. ..... 220/522; 215/227; 215/228; 215/232; 215/252; 215/307; 215/902; 206/217; 220/255; 220/521; 220/203.01; 220/203.29

[58] Field of Search ..... 215/228, 232, 215/902, 295, 296, 251, 252, 227, 307, 309, DIG. 8; 220/521, 522, 255, 256, 258, 202, 203.01, 203.02, 203.08, 203.29; 206/457, 217

[56] References Cited

U.S. PATENT DOCUMENTS

| | | | |
|---|---|---|---|
| 3,367,484 | 2/1968 | Nelson | 220/521 X |
| 3,485,353 | 12/1969 | Reiter | 220/521 X |
| 3,581,927 | 6/1971 | Langdon | 220/521 X |
| 3,613,955 | 10/1971 | Wetherell, Jr. | 215/DIG. 8 X |
| 4,340,138 | 7/1982 | Bernhardt | 220/521 X |
| 4,610,370 | 9/1986 | Patterson et al. | 220/203.08 |
| 4,832,201 | 5/1989 | Kenyon, II | 215/232 X |
| 5,056,659 | 10/1991 | Howes et al. . | |
| 5,114,011 | 5/1992 | Robbins, III | 215/DIG. 8 X |
| 5,178,293 | 1/1993 | Suzuki et al. | 220/359 |
| 5,205,426 | 4/1993 | McBride et al. | 215/252 |
| 5,439,103 | 8/1995 | Howes | 206/217 |

FOREIGN PATENT DOCUMENTS

| | | | |
|---|---|---|---|
| 6024467 | 2/1994 | Japan | 220/359 |

*Primary Examiner*—Allan N. Shoap
*Assistant Examiner*—Robin A. Hylton
*Attorney, Agent, or Firm*—Rockey, Milnamow & Katz, Ltd.

[57] ABSTRACT

A promotional closure includes a sealed promotion-receiving member in the form of a compartment positioned generally within an outer closure cap, for disposition within an associated container. The sealed configuration of the promotion compartment desirably acts to isolate the promotional element therein from the contents of the container. Use on a container having carbonated contents is particularly facilitated by an arrangement by which a plastic film cover member which seals the compartment is sealed to an annular flange of the compartment to permit predetermined delamination and release of gas pressure from within the interior of the compartment.

9 Claims, 1 Drawing Sheet

CLOSURE HAVING SELF-VENTING, SEALED PROMOTION COMPARTMENT

TECHNICAL FIELD

The present invention relates generally to promotional closures for containers configured for use in connection with a sales promotion or game, and more particularly to a sealed promotion-receiving compartment for a closure which is configured to vent gas pressure from within the compartment.

BACKGROUND OF THE INVENTION

Promotions and games which are associated with the sale of products have shown enduring popularity with consumers. A wide variety of such promotions and games are known, and may include gaming systems where game elements are collected to receive an award, or receipt by a consumer of a promotional element which can be redeemed for an award or which may have intrinsic value for the consumer.

Promotional systems for use with container closures have heretofore taken various forms. For example, it has been known to provide the liner portion of a closure in the form of a gaming piece, whereby collection of certain ones of the liners permits prize redemption, or the liners themselves can be individually redeemed for cash or other awards. It has also been known to provide container closures with a compartment element positionable generally within the closure so that a promotional element can be positioned within the compartment for removal upon opening of the container. Closure/compartment arrangements of this nature are disclosed in U.S. Pat. No. 5,056,659, to Howes et al., hereby incorporated by reference.

While the provision of a promotion-receiving compartment member within a closure cap provides a highly appealing promotional system for consumers, it is desirable that the promotional element be isolated from the contents of the associated container. To this end, it is desirable to seal the promotion-receiving compartment element in a manner which is substantially liquid-tight. However, experience has shown that use of such a sealed promotion compartment on a carbonated beverage can result in migration of carbonation gas into the interior of the compartment (gas pressure within the container for carbonated beverage can be on the order of 4 atmospheres after initial packaging).

Upon removal of a promotional closure from a carbonated beverage, it is desirable to effect venting of the gas pressure from within the promotion compartment. The present invention has been particularly configured to provide a sealed promotion compartment which facilitates the venting or release of gas pressure from within the interior of the compartment.

SUMMARY OF THE INVENTION

A promotional closure in accordance with the present invention is particularly suited for use with a container for packaging of carbonated beverages. The closure includes an outer plastic closure cap having a circular top wall portion and a depending annular skirt portion. The closure is adapted for application to an associated container, typically by the provision of interengaging threads. In accordance with the present invention, the promotion-receiving member of the closure includes a sealed cup-shaped promotion compartment positioned generally beneath the top wall portion of the outer closure cap. Notably, the promotion compartment is sealed by a plastic film cover member connected to a flange of the compartment by an arrangement of seals which delaminate in a predetermined fashion to facilitate release of gas pressure from within the compartment.

As noted, the promotion compartment of the present invention is positioned beneath the top wall portion of the outer closure cap, and inwardly of the annular skirt portion of the cap for disposition generally within an associated container. The cup-shaped promotion compartment includes a circular bottom wall, and an upstanding, generally cylindrical side wall extending upwardly therefrom. In the preferred form, the compartment includes an annular flange extending outwardly from the side wall.

In accordance with the illustrated embodiment, the promotion compartment of the present closure includes an arrangement for sealing the interior of the compartment, and a vent arrangement to facilitate release of gas pressure from within the interior of the compartment. In the preferred form, the sealing arrangement comprises a plastic film cover member connected to the annular flange of the compartment. The venting arrangement of the compartment is provided in the form of specifically configured seals which connect the plastic film cover member to the annular flange of the compartment. In particular, an annular primary seal is provided for releasably connecting the plastic film cover member to the flange member, with the annular primary seal at least partially delaminating under the influence of gas pressure within the compartment acting against the plastic film member, to thereby release gas pressure.

In the preferred embodiment, the venting arrangement further includes at least one vent channel extending generally radially outwardly from the annular primary seal. The vent channel accommodates the flow of gas therethrough after delamination of the annular primary seal. In the preferred embodiment, the sealing arrangement further includes at least one, and preferably a plurality of circumferentially spaced outer seals positioned radially outwardly of the annular primary seal in spaced relationship thereto. By virtue of this spacing between the primary and outer seals, a circumferentially extending vent passage is defined therebetween, with the vent passage being in flow communication with the pressure-releasing vent channel. By the preferred provision of a plurality of the outer seals, a plurality of the vent channels are defined, with each vent channel being defined between each adjacent pair of the outer seals. Each of the vent channels is thus in flow communication with the circumferentially extending vent passage. It is further contemplated that at least one vent opening extending through the annular flange can be provided in flow communication with the circumferential vent passage.

By this arrangement of seals and passages, release of gas pressure from within the compartment is effected in a controlled and predetermined manner. After removal of the promotional closure from an associated container, the relatively high pressure within the promotion compartment (resulting from the migration of gas pressure into the compartment subsequent to packaging of the carbonated product) results in gas pressure acting against the inside surface of the plastic film cover member on the compartment. The influence of this gas pressure effects at least partial delamination of the primary annular seal between the film member and the annular flange of the compartment. While the exact region at which sufficient delamination takes place to release gas pressure is believed to be generally random, gas pressure is released past the primary seal into the circumferentially extending vent passage. Gas pressure can then flow through one or more of the vent channels in flow communication with the vent passage and/or through the vent opening(s) in the annular flange.

Other features and advantages of the present invention will become readily apparent from the following detailed description, the accompanying drawings, and the appended claims.

DETAILED DESCRIPTION

Figure 1:
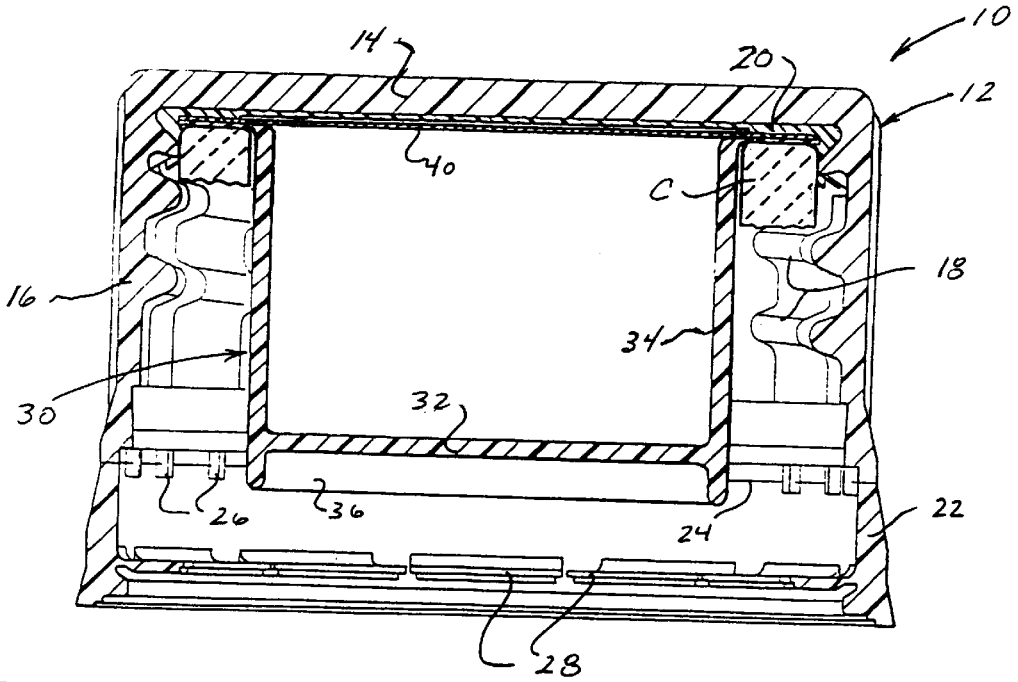
FIG. 1 is a side elevational cross-sectional view of a promotional closure having a sealed promotion-receiving member embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference first to FIG. 1, therein is illustrated a promotional closure 10 including a sealed promotion-receiving member embodying the principles of the present invention. Promotional closure 10 is particularly configured for use with an associated container, a portion of which is illustrated and is designated C, such as by threaded application to a neck portion of the container. Closures of the type illustrated in FIG. 1 can be formed in accordance with the teachings of U.S. Pat. No. 4,497,795, hereby incorporated by reference. Use of the present closure for carbonated beverages is particularly contemplated.

Closure 10 includes a molded plastic outer closure cap 12 having a circular top wall portion 14 and a depending annular skirt portion 16. The annular skirt portion 16 includes an internal helical thread formation 18 configured for cooperating threaded engagement with the associated container C. A sealing liner 20 positioned adjacent the top wall portion 14 of the closure facilitates sealing engagement of the closure with an associated container, and permits the closure to be configured for use with containers having carbonated contents.

The illustrated closure 10 is of the so-called tamper-indicating type, and includes a detachable pilfer band 22 depending from the annular skirt portion 16. The pilfer band 22 is distinguished from the upper closure cap 12 by a circumferentially extending scoreline 24, with a plurality of circumferentially extending frangible ribs 26 extending between the inside surfaces of the closure cap and the pilfer band. A plurality of circumferentially spaced container-engaging flexible projections 28 extend inwardly of the pilfer band, for cooperating engagement with the locking portion of the associated container. By such cooperating engagement, the frangible ribs 26 split and fracture during removal of the closure from the container, thereby separating the pilfer band from the skirt portion 16 of the closure cap for the desired tamper-evidence. The illustrated embodiment of the pilfer band is configured in accordance with U.S. Pat. No. 4,938,370, hereby incorporated by reference, but may alternately be configured in accordance with the teachings of U.S. Pat. No. 4,418,828, hereby incorporated by reference.

Figure 2:
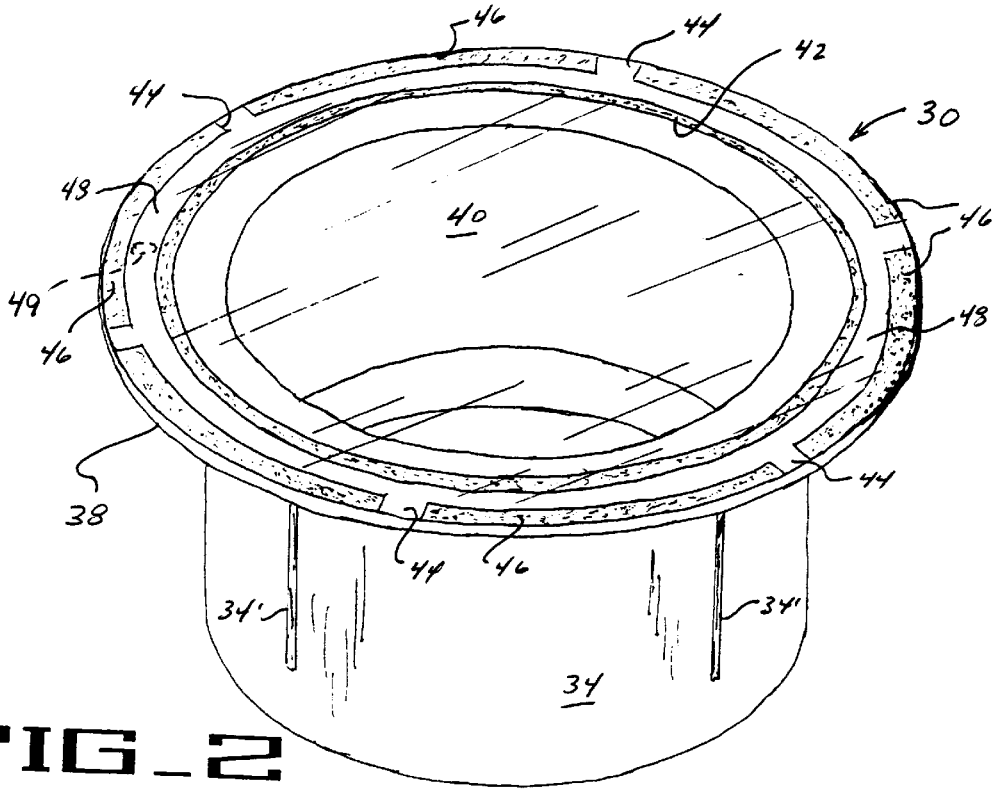
FIG. 2 is a top perspective view of the sealed promotion-receiving member of the present invention.

The closure 10 is intended for use in connection with consumer promotions or games, and to this end, the closure includes a promotion-receiving member positioned generally within the closure cap 12. As illustrated in FIGS. 2 and 3, the promotion-receiving member is provided in the form of a promotion compartment 30 having a generally cup-shaped configuration including a circular bottom wall 32, and a generally cylindrical upstanding side wall 34 extending upwardly from the bottom wall 32. In the preferred form, the promotion compartment 30 includes a depending annular flange 36 which facilitates removal of the compartment from within the closure cap 12. The side wall 34 is preferably provided with a pair of preferentially weakened regions 34' which permit the compartment to split or open to facilitate removal of a promotional element from within the compartment.

The compartment 30 is preferably of unitary construction, and preferably molded from low density polyethylene plastic material. Positioning of the compartment 30 within the closure cap 12 is facilitated by the provision of an annular flange 38 which extends generally outwardly from the upper edge of the side wall 34. The annular flange 38 is preferably interengaged with a deformable portion of the sealing liner 20 of closure 10, such as by the provision of a deformable bead or lip on the liner (generally at an annular bead portion of the liner adjacent skirt portion 16) which fits between the container C and the flange 38, and generally encapsulates the peripheral portion of the flange and a sealing cover member applied thereto. As will be observed in FIG. 1, the flange 38 is held in generally captive relationship between the container C and the inside surface of the liner 20 within closure cap 12.

A suitable promotional element can be positioned within the interior of the compartment 30. Such a promotional element can be provided in the form of a coupon redeemable for an award or the like, folded currency (i.e., cash), or some other suitable promotional article. Sealing and retention of the promotional element within the compartment is desirably enhanced by the optional provision of a cover member 40 fitted to the flange 38, which cover member 40 is preferably provided in the form of a suitable plastic film or the like heat-sealed or otherwise secured to the flange 38 of the compartment. The plastic film cover member 40 further acts to desirably isolate the contents of the compartment from the contents of the associated container C.

In accordance with the present invention, the plastic film cover member 40 is connected to the annular flange 38 in a manner which facilitates the venting and release of gas pressure from within the interior of the promotion compartment 30. Generally, a venting arrangement is provided in the form of selectively configured seals (which may comprise heat-seals, adhesive seals, or like sealing arrangements) which are configured to delaminate in a predetermined fashion, and permit gas pressure to flow from within the interior of the compartment via a vent passage and vent channel arrangement.

As illustrated in FIG. 2, the seal arrangement of the compartment 30 includes an annular primary seal 42 which extends continuously between the plastic film cover member 40 and the annular flange 38. Gas pressure in the interior of the compartment acts against cover member 40 for at least partially delaminating the annular primary seal 42.

The seal arrangement further includes at least one, and preferably a plurality of circumferentially spaced, radially extending vent channels 44. As shown, the vent channels 44 are defined between each adjacent pair of a plurality of circumferentially spaced outer seals 46 which are spaced radially outwardly of the annular primary seal 42. By virtue of this radial spacing, a circumferentially extending vent passage 48 is defined between the primary seal 42 and the plurality of outer seals 46. As will be observed, each of the radially extending vent channels 44 is in fluid flow communication with the circumferentially extending vent passage 48. As will be recognized, the plastic film cover member 40 preferably extends generally to the outer periphery of annular flange 38, with the cover member 40 being joined to the annular flange at seals 42, 46, and unsealed at vent channels 44 and vent passage 48.

In addition or alternatively to the provision of radial vent channels 44, the compartment 30 can be provided with at least one vent opening 49 (shown in phantom line in FIG. 2) extending through annular flange 38, and in fluid flow communication with circumferential vent passage 48. The provision of one or more openings 49 extending through said flange radially outwardly of annular seal 42 facilitates release of gas pressure from within the compartment 30 after removal of closure 10 from the associated container, but prior to removal of compartment 30 from within closure cap 12.

When the sealed compartment 30 is fitted within the associated outer closure cap 12, it is presently preferred that the peripheral portion of annular flange 38, including the peripheral portion of plastic film cover member 40 be encapsulated and sealed within the above-described deformable lip or bead of the sealing liner 20 (adjacent skirt portion 16) of the closure 10. With the sealed compartment thus in place within the closure, the continuous primary seal 42 provides the primary seal for the promotion compartment, with the radially extending vent channels 44 "pinched" between the deformable lip of the liner and the portion of the liner adjacent thereto during application of the closure to a container to provide a secondary seal.

Upon opening of the container by removal of closure 10, pressure within the container is vented, and a pressure differential is created between the interior of the compartment 30 and the exterior thereof (with gas pressure within the compartment resulting from the migration of gas into the compartment at the elevated pressures associated with packaging of carbonated beverages). As the closure 10 is removed from the container, the plastic film cover member 40 begins to bulge as the gas pressure within the interior of the compartment acts against the inside surface of the cover member. The influence of this gas pressure acting on the cover member acts to delaminate the primary seal 42. As one or more portions of the primary seal 42 delaminate sufficiently to allow the release of gas pressure, gas flows into the circumferential vent channel 48, and thereafter can flow through one or more of the radially-extending vent channels 44, and/or the one or more vent openings 49.

Opening of the compartment is preferably effected by upward manipulation of the annular flange 38 which is preferably detachably connected to a major portion of the side wall 34. The annular flange is preferably connected to the section of the side wall extending between preferentially weakened regions 34', whereby the compartment may be split or opened to facilitate access to the promotion therein.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover by the appended claims all such modifications as fall within the scope of the claims.

What is claimed is:

1. A promotional closure for a container comprising:

a closure cap having a top wall portion and a depending annular skirt portion; and a promotion-receiving member comprising a promotion compartment positioned beneath said top wall portion of said closure cap and inwardly of said annular skirt portion for disposition within said container;

said promotion compartment having a generally cup-shaped configuration including a bottom wall, and an upstanding side wall extending upwardly therefrom together defining the interior of said promotion compartment;

said promotion compartment including means for sealing the interior of said promotion compartment, and vent means to facilitate release of gas pressure from within the interior of the compartment, said sealing means comprising a plastic film cover member, said vent means comprising an annular primary seal for releasably connecting said plastic film member to a flange extending outwardly from said side wall, said annular seal at least partially delaminating under the influence of gas pressure within said compartment acting against said plastic film member to release the gas pressure.

2. A promotional closure in accordance with claim 1, wherein said vent means further includes at least one vent channel extending radially outwardly from said annular seal, said vent channel accommodating the flow of gas therethrough after said delamination of said annular seal.

3. A promotional closure in accordance with claim 2, wherein at least one outer seal positioned radially outwardly of said annular primary seal in spaced relationship to said annular primary seal, said outer seal and annular primary seal together defining a circumferentially extending vent passage therebetween, said vent passage being in flow communication with said vent channel.

4. A promotional closure in accordance with claim 3, wherein said seal means comprises a plurality of said outer seals each positioned radially outwardly of said annular primary seal, said outer seals being spaced apart to define one of said vent channels between each adjacent pair of said secondary seals, each of said vent channels being in flow communication with said circumferentially extending vent passage.

5. A promotional closure in accordance with claim 1, wherein said annular flange includes at least one vent opening extending therethrough in communication outwardly of said annular primary seal.

6. A promotional closure for a container, comprising;

a plastic closure cap having a top wall portion and a depending annular skirt portion; and a promotion-receiving member comprising a promotion compartment positioned generally beneath said top wall portion of said closure cap and inwardly of said annular skirt portion for disposition generally within said container;

said promotion compartment having a generally cup-shaped configuration including a bottom wall, an upstanding side wall extending upwardly therefrom together defining the interior of said promotion compartment, and an annular flange extending generally outwardly from said side wall, said compartment including a cover member releasably connected to said annular flange for sealing the interior of said compartment, said cover member being connected to said annular flange by an annular primary seal, and a plurality of circumferentially spaced apart outer seals positioned radially outwardly of said annular primary seal to define a circumferentially extending vent passage therebetween, each adjacent pair of said spaced apart outer seals defining therebetween a radially extending vent channel in flow communication with said vent passage, said primary seal at least partially delaminating under the influence of gas pressure within the interior of said compartment to permit flow of gas through said vent passage and at least one of said vent channels.

7. A promotional closure in accordance with claim 6, wherein said annular flange defines at least one vent opening extending therethrough in communication with said circumferentially extending vent passage.

8. A promotional closure for a container, comprising;

a plastic closure cap having a top wall portion and a depending annular skirt portion; and a promotion-receiving member comprising a promotion compartment positioned generally beneath said top wall portion of said closure cap and inwardly of said annular skirt portion for disposition within said container;

said promotion compartment having a generally cup-shaped configuration including a bottom wall, an upstanding side wall extending upwardly therefrom together defining the interior of said promotion compartment, and an annular flange extending outwardly from said side wall, said compartment including a cover member releasably connected to said annular flange, said cover member being connected to said annular flange by at least one seal configured to releasably connect said cover member to said annular flange, said seal forming at least one vent channel to permit flow of gas from within the interior of said promotion compartment through said vent channel.

9. A promotional closure in accordance with claim 8, wherein said cover member is connected to said annular flange by a plurality of circumferentially spaced apart seals, each adjacent pair of said spaced apart seals defining one of said vent channels therebetween.

* * * * *